US007141258B2

(12) United States Patent
Hillmann

(10) Patent No.: US 7,141,258 B2
(45) Date of Patent: Nov. 28, 2006

(54) METHOD OF TREATING AND PREPARING FOOD IN A COOKING DEVICE, CONTROL PANEL FOR A COOKING DEVICE AND COOKING DEVICE COMPRISING A CONTROL PANEL

(75) Inventor: Johannes Hillmann, Neu-Ulm (DE)

(73) Assignee: eloma GmbH Grosskuchentechnik, Maisach (DE)

( * ) Notice: Subject to any disclaimer, the term of this patent is extended or adjusted under 35 U.S.C. 154(b) by 393 days.

(21) Appl. No.: 10/373,227

(22) Filed: Feb. 24, 2003

(65) Prior Publication Data

US 2003/0161922 A1 Aug. 28, 2003

(30) Foreign Application Priority Data

Feb. 25, 2002 (EP) ..... 02004106

(51) Int. Cl.
*A47J 37/00* (2006.01)

(52) U.S. Cl. ..... 426/233; 426/523; 99/331; 99/337; 99/468; 99/476; 219/393; 219/401

(58) Field of Classification Search ..... 426/231, 426/233, 523; 99/325, 350, 331, 337, 468, 99/476; 219/401, 393
See application file for complete search history.

(56) References Cited

U.S. PATENT DOCUMENTS 6,080,972 A * 6/2000 May ..... 219/494
6,486,453 B1 * 11/2002 Bales et al. ..... 219/702
6,497,907 B1 * 12/2002 Hofer ..... 426/233
6,587,739 B1 * 7/2003 Abrams et al. ..... 700/83
6,750,433 B1 * 6/2004 Guenther et al. ..... 219/506

FOREIGN PATENT DOCUMENTS

| | | | |
|---|---|---|---|
| DE | 3039301 A | * | 5/1982 |
| DE | 3701308 A1 | * | 7/1988 |
| GB | 2 323 436 | | 9/1998 |
| JP | 06119136 | | 4/1994 |
| WO | WO 97/37515 | * | 10/1997 |
| WO | WO 98/5904 A1 | * | 2/1998 |

* cited by examiner

*Primary Examiner*—Drew Becker
(74) *Attorney, Agent, or Firm*—Jansson, Shupe, Munger & Antaramian, Ltd.

(57) ABSTRACT

The present invention refers to a method of treating and preparing food in a cooking device, in which a plurality of cooking parameters can be set, wherein the cooking process is carried out by means of an adjustable cooking program, wherein the setting of the cooking parameters is carried out by an input device. By means of the input device a point in an at least two-dimensional map is controlled by the operator of the cooking device, in which at least two cooking parameters are defined, and the adjusted point is implemented into the cooking program as part of the cooking process. The present invention also comprises a control panel for a cooking device, in particular for a steam cooking device and a cooking device equipped with this control panel.

23 Claims, 4 Drawing Sheets

METHOD OF TREATING AND PREPARING FOOD IN A COOKING DEVICE, CONTROL PANEL FOR A COOKING DEVICE AND COOKING DEVICE COMPRISING A CONTROL PANEL

FIELD OF THE INVENTION

The present invention refers to a method of treating and preparing food in a cooking device.

The present invention further refers to a control panel for a cooking device, as well as a cooking device comprising such a cooking panel, in particular an improved steam cooking device.

BACKGROUND OF THE INVENTION

Methods of treating and preparing food by means of various cooking devices have been known for many years. In carrying out the cooking process, one must select from a number of different parameters. Conventionally, a selection is made from one of the operating modes offered by a cooking device that is dependent on the food to be cooked. Operating modes of this type are, for instance, hot air, steaming, frying, regenerating, etc.

After the mode of operation has been selected, a selection from other parameters takes place which correspond to this mode of operation. In addition to the selected mode of operation, these selections must be input by the person operating the cooking device, such as the temperature, humidity, etc., and these values must be input independent of one another in successive steps.

The process of cooking food is usually carried out by way of one or more programed steps, e.g. heating-up, steaming, roasting and subsequent browning, wherein each individual step must be selected by the operator who then inputs the respective parameters.

The input is conventionally made on a display panel having a line-shaped structure that shows the corresponding choices in parameters as a plurality of lines and allowing each parameter to be controlled, e.g. by means of a rotary knob. When reaching the correct value, the parameter is selected by pressing a certain confirmation key for this program step.

SUMMARY OF THE INVENTION

The object of the present invention is to provide a method of treating and preparing food in a cooking device where the parameters of the cooking process can be selected in an extremely simple manner.

The object of the invention is further to provide a control panel for a cooking device, in particular a steam cooking device, by means of which the determination of the cooking process can be managed in a very simple manner.

The present invention is furthermore based on the objective of providing a cooking device in which each of the above-mentioned aims are also realized.

According to the present invention, a method of treating and preparing food in a cooking device is provided where a plurality of cooking parameters can be selected by an operator of the cooking device and where the cooking process can be carried out by means of an adjustable cooking program. The method comprises the steps of the operator choosing a point on an at least two-dimensional map by means of an input device wherein at least two cooking parameters are selected on the cooking device and then implementing that selection into the cooking program as part of the cooking process.

Thereby it is advantageously achieved that the parameter settings selected by the operator, usually the cook, can be made in not only a simple but also quick manner. Moreover, the operating safety is clearly increased. Therefore input errors are avoided to a great extent.

One preferred embodiment of this method is where the temperature or humidity to be reached in the cooking chamber, the velocity of the fan wheel of the cooking device, the browning degree of the food to be cooked and/or the core temperature of the food to be cooked can be selected as cooking parameters.

In order to provide the operator (cook) and in particular unskilled or semi-skilled persons with aid when selecting the cooking parameters, panels for different cooking processes are predefined and are displayed on the map so that one can be selected by the input device. These predefined panels are displayed either graphically or photographically and are regarded by an expert as the "language of cooking".

In an especially advantageous manner, every point on the map can be reached so that any possible combination of preselected cooking parameters can be set. This may for instance be the temperature and the humidity in the cooking chamber, thus setting the cooking chamber climate. As an alternative, different parameters, such as cooking time, core temperature, fan wheel velocity, browning degree of the food to be cooked, can form the basis of the map and can be selected by the operator, depending on the step of the cooking process. This allows the operator to select from an entire spectrum of possible cooking parameters, with extreme settings also being possible.

The treatment and preparation of food is known to be very stressful as personnel must perform a huge number of different jobs in any type of kitchen, no matter whether it is a canteen kitchen or a gourmet restaurant. The simpler and safer a cooking process can be made, the better. The food shall also be protected against over-cooking to achieve its maximum edible quality.

In an especially advantageous manner, control over the program point on the map is implemented by a multi-dimensional input device, such as a rocker switch, a joystick, a computer mouse or a touch pad, the latter being known from a laptop.

The rocker switch may, for instance, be designed such that it is operable in eight directions: upwards, downwards, towards the left, towards the right, diagonally up left, diagonally up right, diagonally down left and diagonally down right. As an alternative, the point on the map to be selected may also be controlled by the operator by means of a computer mouse or a touch pad.

As soon as the point in the map to be selected for the cooking process is reached, a confirmation key can be operated for defining and implementing the selected program point. This key may for instance be provided as a separately movable central key in the control panel or as a vertical shift of the joystick. In the case of a mouse, the input confirmation is generated by a corresponding button action, e.g. by a double click of the left or right mouse button. This analogously applies to the touch pad.

According to the present invention, a control panel for a cooking device, in particular a steam cooking device, is provided comprising an input device for setting a plurality of cooking parameters and a display member which at least displays the cooking parameters and cooking program steps set. Advantageously, the display member comprises an at least two-dimensional map, on which at least two cooking parameters are defined and on which a point in the map may be controlled or selected by action of the operator on the input means.

In an especially preferred manner, the map is a substantially planar surface.

In a further preferred manner, the map is formed as a rectangular monitor surface.

The present invention finally also comprises a cooking device, in particular a steam cooking device, which is characterized in that it comprises a control panel as described above.

Further details, features and advantages of the present invention can be derived from the following description with reference to the drawings.

DETAILED DESCRIPTION OF PREFERRED EMBODIMENTS

Figure 1:
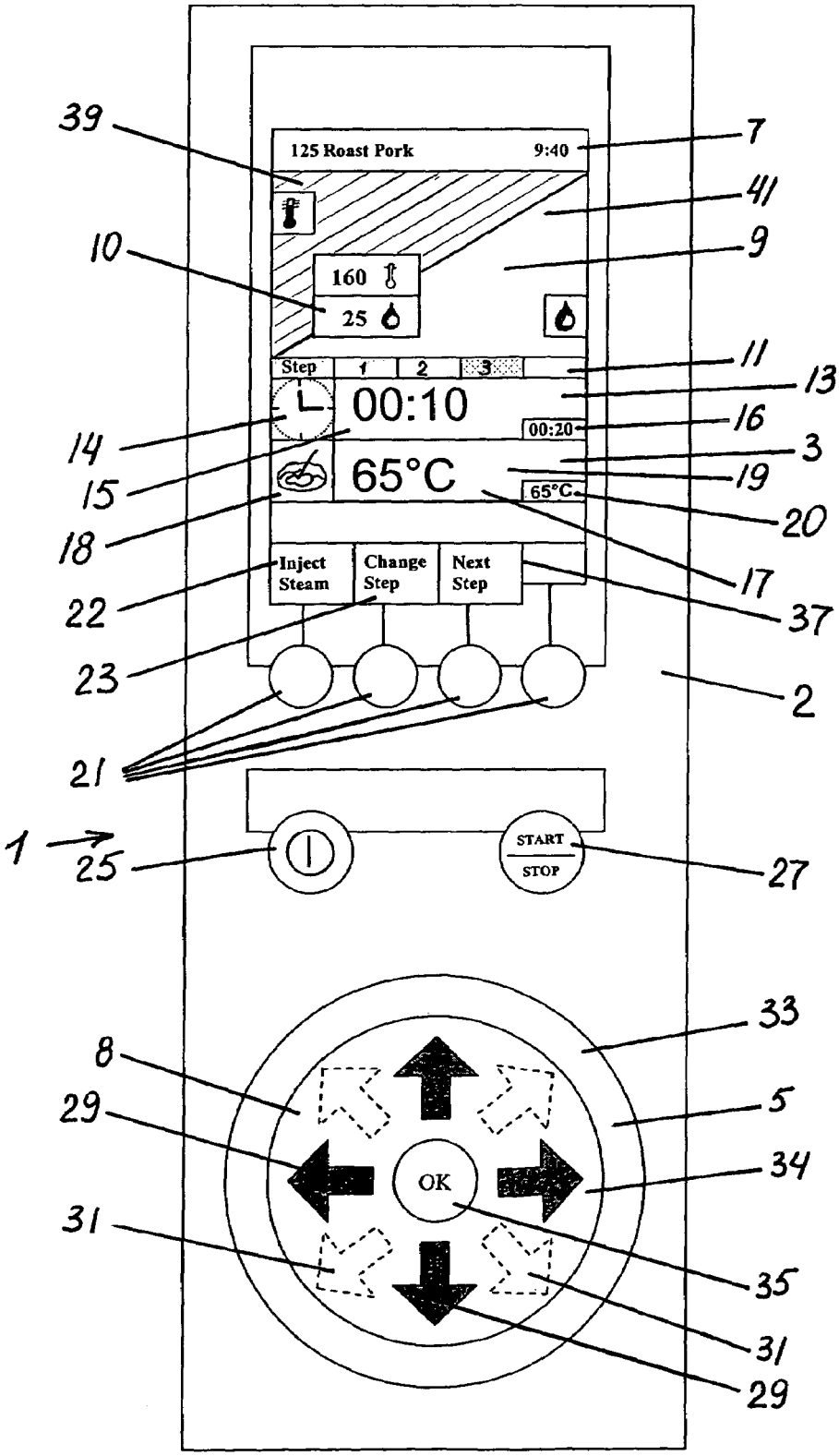
FIG. 1 shows a control panel according to the invention in a front view.

FIG. 1 shows a control panel according to the invention. The control panel comprises a display member 3 and an input device 5.

As can be seen from FIG. 1, the display member 3 consists of a plurality of display panels. According to the embodiment shown, a first display panel 7 is provided in which the type of the food to be cooked is shown. In the example, this is "roast pork". Below that a map 9 according to the invention is located, which will be described further below. Below that a second display panel 11 is located, in which the number of program steps is given. In FIG. 1, the number of steps shown is 3. The respective method step is then color-illuminated so that the operator immediately recognizes in which method step he is.

Below that a third display panel 13 is located which is divided into three panels: a first left display panel 14 carrying the symbol of a clock, a first main display panel 15 with a time (in FIG. 1 00.10=10 minutes) and a first target value display panel 16 in which the total time of the cooking program step is indicated. In the example shown in FIG. 1, the operator immediately recognizes that 10 minutes of the 20 minute cooking process have already lapsed.

This is followed below by a fourth display panel 17 structured analogously to third display panel 13. In fourth display panel 17, the core temperature is shown, which is symbolically shown in the second left display panel 18. The actual temperature is indicated in the second main display panel 19, and the temperature to be reached is indicated in the second target value display panel 20. In the embodiment shown according to FIG. 1, it can be derived that the target value core temperature of 65° C. has been reached and 10 further minutes are required to fully perform the pre-adjusted cooking process.

In addition to the numeric indication in the main display panels 15 and 19, these panels can also be underlined by an analog display, e.g. in the form of a gray bar, which grows towards the right with the progressive duration or increase of the temperature. The operator quickly recognizes the analog target-actual value comparison.

Four operating keys 21 are located below the display member 3 according to the embodiment of FIG. 1. According to a preferred embodiment of the present invention, these four operating keys 21 are formed as capacitive keys. That means that these keys are arranged behind an outer surface 2 of the control panel 1, which can for instance be made of glass. By touching the outer surface 2 in the area of one of the operating keys 21, this key is operated without the operator having to exert pressure onto this key. The special advantage of this embodiment is that the control panel 1 has a closed outer surface 2 which offers an appropriate protection against the electronics arranged therebehind. It is known that the degree of pollution is enormous in kitchens so that the appliances located in the kitchen must be particularly protected against outer influences. This protection is excellently realized by the control panel according to the present invention.

Moreover, the outer surface 2 can also be cleaned easily which is especially favorable in that excellent hygiene is achieved as a special advantage.

By means of one of the operating keys 21, different program control processes and program changing processes can be carried out. The operating keys are advantageously freely selectable. Thus, a respective steam shot, as shown in fifth display panel 22, is generated by the operating key 21 located on the very left that is connected to fifth display panel 22.

The operating key 21 following on the right-hand side enables a program change, as can be seen in FIG. 1 from the indication "change step" in sixth display panel 23. The next operating key 21 follows on the right-hand side. When operating this key, the next step of the cooking process program can be initiated. The operating key arranged on the very right-hand side is not occupied in the example shown. Due to the free programming of the operating keys 21, variable menus can be realized.

As may be seen from FIG. 1, a further key panel with a left and a right key 25 and 27 is located below the operating keys 21. The cooking device is switched on by the left key 25 and the cooking program is started, ended or interrupted by the right key 27.

The operating keys 21 and/or the left and/or right key 25, 27 may comprise light emitting diodes which fulfill corresponding indication functions. Such a LED display is for instance advantageous in the left key 25, since it is indicated to the operator that the apparatus is still in operation and is switched off after operating this key again.

As may be seen from FIG. 1, the input device 5 is arranged in the lower portion of the control panel 1. In the embodiment shown, the input device 5 has the form of a rocker switch 8. Such a rocker switch 8 is known per se. In the embodiment show, it can be operated in eight directions according to the full arrows 29 and dotted arrows 31. The input device has an outer circumferential wall 33 which extend circularly around the operating rocker surface 34.

A central operating key 35 (inscription "OK") is arranged in the center on the operating rocker surface 34. By pressing this key, the point controlled and selected in the map is implemented into the cooking program.

By means of the input device 5, the climate parameters temperature and humidity in the cooking chamber are determined. In FIG. 1 this point in the map 9 is characterized by the display 10 in which according to the embodiment of FIG. 1 the temperature indication 160 plus thermometer pictogram and 25 plus water drops are indicated. In other words, the cooking process step that took place there was adjusted to 160° C. and to 25% humidity.

By pressing the operating rocker switch 8 onto one of the arrows 29 or 31 the point in the map indicated by the display 10 is shifted accordingly. The incrementation of the map may for instance be 1° C. and 1% humidity. Finer or coarser gradations can also be set. When the choice of the next point has taken place, this point is defined as the next program point by pressing the confirmation key 35 after previously the operating key 21 assigned to the seventh display panel 37 ("next step") was pressed.

As may also be seen from FIG. 1, the map 9 is basically formed of two partial surfaces which are each formed as a right-angled triangle. The upper partial surface 39 is colored and may for instance be shown in red color, which is the symbol for fire, wherein, as the person skilled in the art may easily recognize, the map 9 is structured such that on the vertical coordinate towards the top temperature is indicated and on the horizontal coordinate the humidity is indicated. The lower partial surface 41 appears for instance in blue color, as a symbol for water, wherein due to the increase of the blue surface from left to right this may be interpreted by the operator as an increase of humidity in the cooking chamber.

Figure 2:
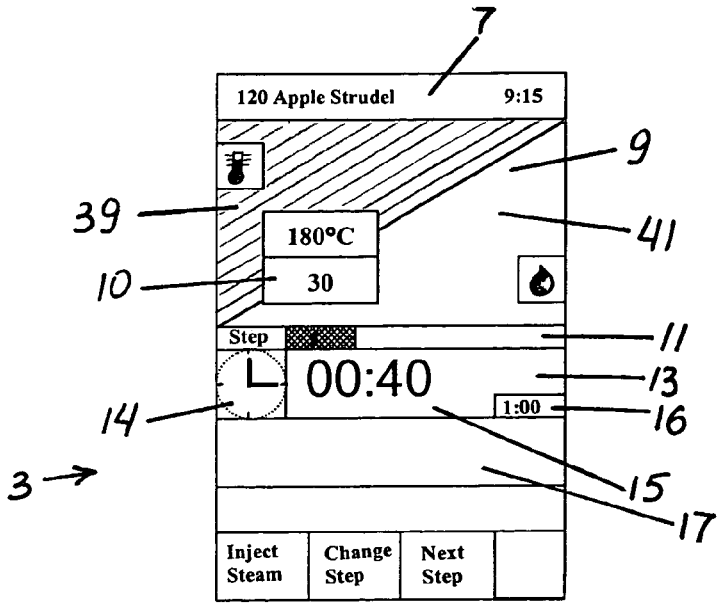
FIG. 2 shows a certain state of the display member according to the invention.

FIG. 2 shows the display member 3 for the cooking process of "Apple Strudel". The cooking chamber climate was set to 180° C. at 30% humidity. The cooking process is in step 1, wherein this step shall take a total of one hour according to the display panel 16. 40 minutes have already lapsed according to the display panel 15. Since the core temperature of the apple strudel is not determined, the lower display panel 17 is empty.

Figure 3:
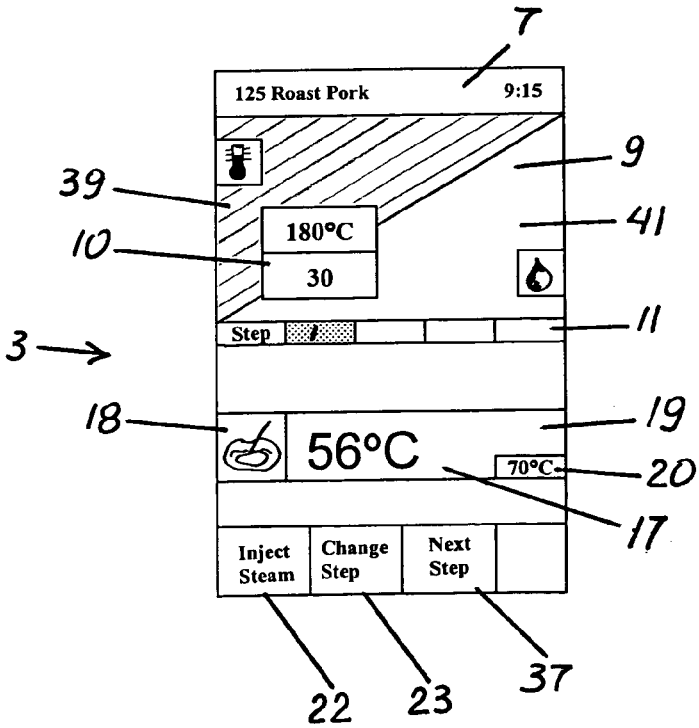
FIG. 3 shows a further state of the display member according to the invention.

FIG. 3 shows an alternative cooking process step 1. The cooking chamber climate was again set to 180° C. at 30% humidity, wherein the cooking process shall be controlled according to the core temper example of FIG. 3, the desired temperature of 70° C. according to the display panel 20 is not reached yet. The display panel 19 only shows 56° C.

Figure 4:
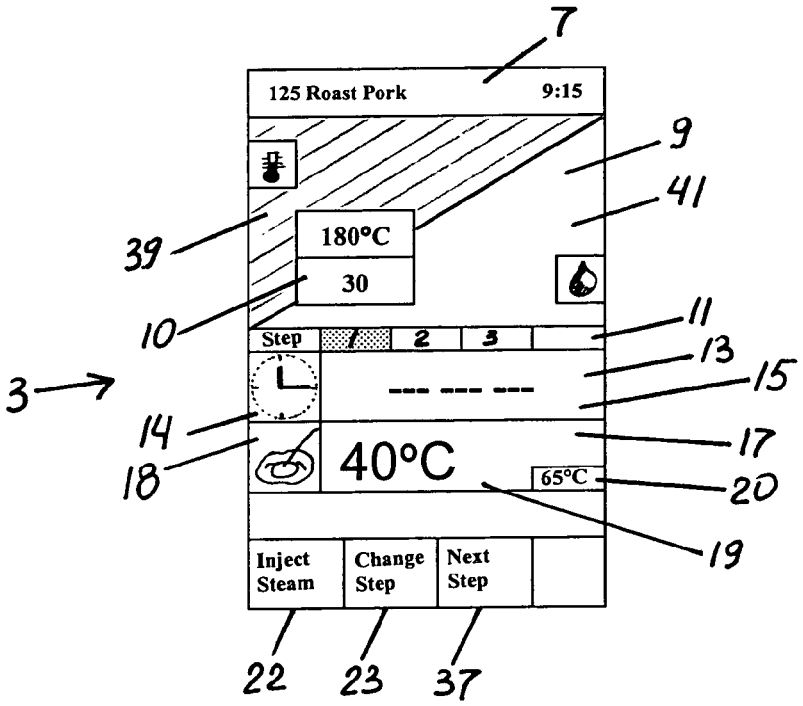
FIG. 4 shows the display of a first program step of a cooking process.
Figure 5:
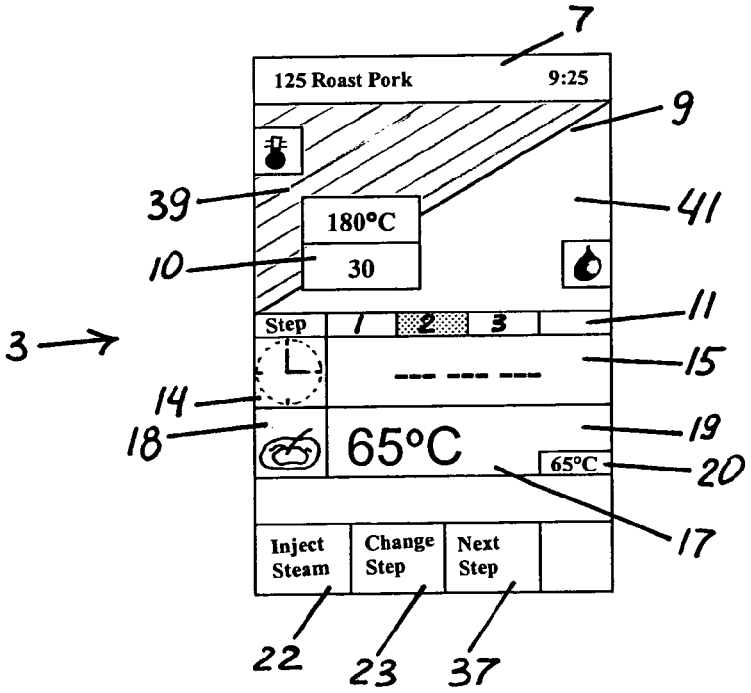
FIG. 5 shows the display of a second step in the same cooking process.
Figure 6:
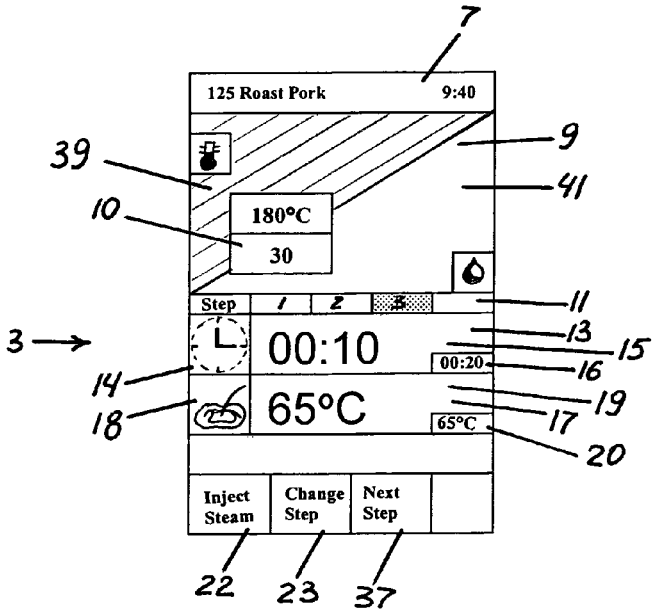
FIG. 6 shows the display of a third step in the same cooking process of FIGS. 4 and 5.

In FIGS. 4 to 6 the cooking process steps 1 to 3 of a cooking process referring to "roast pork" are shown. In step 1, the food is first of all heated at a cooking chamber climate of 180° C. and 30% humidity until a core temperature of 65° C. is reached. According to the display panel 19, only 40° C. has been reached.

FIG. 5 shows a second cooking process step with an unchanged cooking chamber climate compared to the setting of FIG. 4, wherein the actual core temperature of 65° C. is displayed.

According to FIG. 6 the actual core temperature is indicated in this cooking process in a step 3 at an unchanged cooking chamber climate. This temperature is predefined for 20 minutes according to the target value display panel 16, wherein 10 minutes of cooking time remain. FIG. 6 thus shows a time step following the heating-up step of FIG. 5, as it occurs in multi-stage cooking programs.

Figure 7:
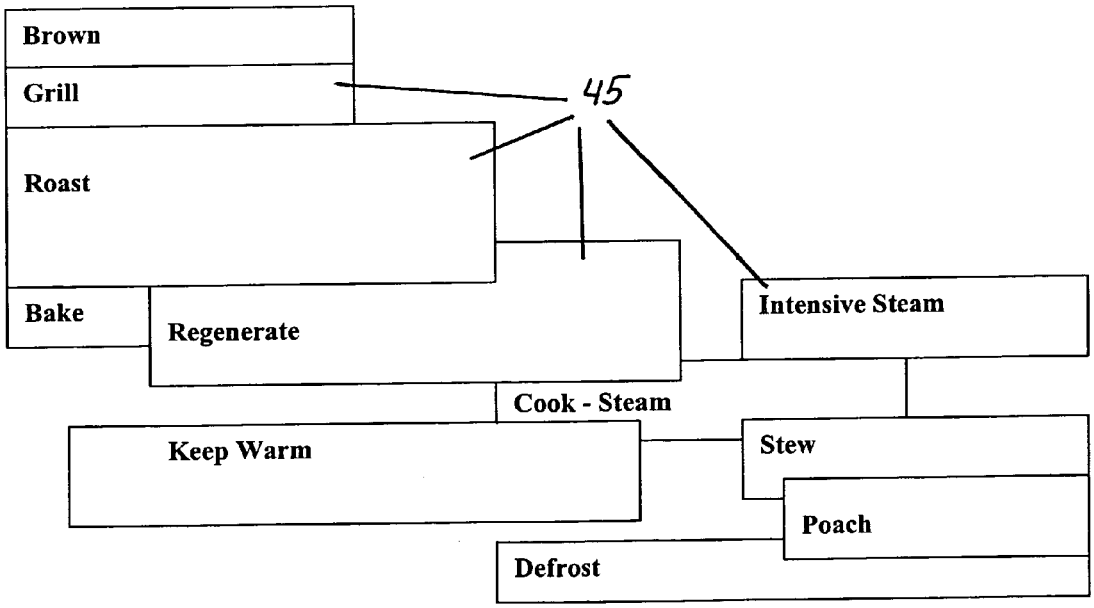
FIG. 7 shows the panels according to the "language of cooking" that correspond to a map including temperature and moisture as cooking parameters.

FIG. 7 shows in panels 45 different preparation modes for food. Each panel 45 contains a respective step of preparation, wherein the arrangement of the panels with respect to each other is made in that in the map towards the top the temperature and towards the right the humidity are increasingly shown. It results therefrom that the hottest operating mode at a simultaneous lowest humidity "browning" is arranged on the top left. Vice versa is the treatment mode "poaching" arranged at low temperature but very high humidity. When starting a point in map 9 in the outlined panel 45, this panel is indicated and the operator familiar with the "language of cooking" can therefore correctly and very quickly decide whether the started point shall be selected or not.

Thus, a method of treating and preparing food in a cooking device is provided by the present invention, in which cooking parameters can easily be set by the operator. By means of the rocker switch 8, the operator is able to shift the cooking parameter point to be set (display 10) similar to a cursor in the map 9. If the operator presses onto arrows 29 upwards or downwards, the cursor point can also be moved into display panels 13 and 17. By pressing onto the arrows towards the left or right, the corresponding value can be reduced or increased in the respective display panel.

The present method also includes treatment steps and modes such as hot or cold smoking.

Thus, an extremely simple and easily operable display panel is provided by the present invention, wherein the expression "control panel" also comprises the corresponding control means and connection means between input device 5 and display member 3.

A cooking device, which comprises such a control panel 1, can therefore excellently be handled by the operator, wherein an extreme simplification in the input of the individual cooking processes is obtained.

The present invention is not restricted to the embodiments shown. The input device can also be formed as a joystick, wherein advantageously this joystick is arranged on a substantially horizontal or transversely arranged surface element. A computer mouse or a touch pad can also be used as multi-dimensional input devices if they are arranged appropriately.

The map may also be formed three-dimensionally, wherein a third parameter is defined in the third dimension.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The invention claimed is:

1. A method of treating and preparing food in a cooking device comprising:

choosing one point on an at least two-dimensional map through use of an input device whereby values for at least two cooking parameters for the cooking device are selected, and implementing the selected values into an adjustable cooking program as part of a cooking process, whereby values of cooking parameters are selected by an operator of the cooking device and the cooking process is carried out through execution of the adjustable cooking program.

2. The method of claim 1 wherein the cooking parameters are selected from a group consisting of temperature, the humidity in the cooking chamber, the velocity of the fan wheel of the cooking device, the browning degree of the food to be cooked, and the core temperature of the food to be cooked.

3. The method of claim 1 wherein the man includes panels, each of the panels indicating a different cooking preparation mode and wherein the choosing step includes choosing one panel on the map through use of the input device, whereby the operator recognizes the cooking preparation mode selected when the point is chosen.

4. The method of claim 1 wherein each point on the map indicates a different combination of temperature and humidity, whereby specific combinations of temperature and humidity in the cooking chamber can be selected.

5. The method of claim 1 wherein the input device is a multi-dimensional input device.

6. The method of claim 5 wherein the multi-dimensional input device is a rocker switch, a joystick, a computer mouse or a touch pad.

7. The method of claim 1 wherein the implementing step includes operating a confirmation key to define and implement the chosen point into the cooking program.

8. A control panel for a cooking device comprising:

an input device for selecting values for a plurality of cooking parameters; and a display member having a plurality of display panels indicating the cooking parameters to be selected, at least one of the display panels being an at least two-dimensional map whereon one point is chosen by operation of the input device to select values for at least two cooking parameters.

9. The control panel of claim 8 wherein the map is a substantially planar surface and is formed as a rectangular monitor surface.

10. The control panel of claim 8 wherein each point on the map indicates a different combination of temperature and humidity, whereby specific combinations of temperature and humidity in the cooking chamber can be selected.

11. The control panel of claim 8 wherein the input device comprises a multi-dimensional input device.

12. The control panel of claim 11 wherein the multi-dimensional input device is a rocker switch, a joystick, a computer mouse or a touch pad.

13. The control panel of claim 11 wherein the multi-dimensional input device further comprises a confirmation key.

14. The control panel of claim 8 wherein the cooking device is a steam cooking device.

15. The control panel of claim 8 wherein the input device is adapted to program a plurality of cooking steps defining a cooking process prior to the execution of any of the cooking steps and the display panels further indicate the programmed cooking steps, whereby values for at least one cooking parameter is chosen through use of the display panels by operation of the input device to program each cooking step.

16. The control panel of claim 15 wherein the cooking step being executed during the cooking process is indicated on the display member.

17. The device of claim 15 wherein the display member includes an operating key such that an operator can adjust the programmed cooking process by changing cooking steps through operation of the operating key.

18. The control panel of claim 15 wherein values for cooking parameters are selected for first and second cooking steps, the cooking steps defining a programmed cooking process, and at least one value selected for the first cooking step is different from each of the values selected for the second cooking step.

19. The control panel of claim 18 wherein each value of the cooking parameters selected for the first cooking step is displayed on the display panels simultaneously during the first cooking step of the cooking process.

20. A device for the treatment and preparation of food comprising a control panel, the control panel having an input device for selecting values for a plurality of cooking parameters and a display member having a plurality of display panels indicating the cooking parameters to be selected, at least one of the display panels being an at least two-dimensional map whereon one point is chosen by operation of the input device to select values for at least two cooking parameters.

21. The device of claim 20 wherein each point on the map indicates a different combination of temperature and humidity, whereby specific combinations of temperature and humidity in the cooking chamber can be selected.

22. The device of claim 20 wherein all values of the cooking parameters of a cooking process are selected only by an operator through use of the input device.

23. The device of claim 20 wherein at least one display panel indicates both the selected value for at least one cooking parameter and a real time value for that cooking parameter.

* * * * *

UNITED STATES PATENT AND TRADEMARK OFFICE

CERTIFICATE OF CORRECTION

PATENT NO. : 7,141,258 B2
APPLICATION NO. : 10/373227
DATED : November 28, 2006
INVENTOR(S) : Johannes Hillmann It is certified that error appears in the above-identified patent and that said Letters Patent is hereby corrected as shown below:

Column 5, line 44, after “core”, delete “temper” and insert --temperature according to the display panel 17. In the--.

Signed and Sealed this

Thirteenth Day of February, 2007

JON W. DUDAS
*Director of the United States Patent and Trademark Office*